US007892114B2

(12) United States Patent
Saegusa et al.

(10) Patent No.: US 7,892,114 B2
(45) Date of Patent: Feb. 22, 2011

(54) METHOD FOR GOLF CLUB SELECTION, AND GOLF CLUB

(75) Inventors: Hiroshi Saegusa, Hiratsuka (JP); Mamoru Miyagawa, Tokyo (JP); Masatoshi Kyoumura, Tokyo (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 6 days.

(21) Appl. No.: 12/428,383

(22) Filed: Apr. 22, 2009

(65) Prior Publication Data

US 2009/0270204 A1 Oct. 29, 2009

(30) Foreign Application Priority Data

Apr. 25, 2008 (JP) ..... 2008-115562

(51) Int. Cl.
*A63B 69/36* (2006.01)

(52) U.S. Cl. ..... 473/409; 473/407

(58) Field of Classification Search ..... 473/150–154, 473/198–199, 407, 409, 219–223; 356/28, 356/28.5

See application file for complete search history.

(56) References Cited

U.S. PATENT DOCUMENTS

| | | | | |
|---|---|---|---|---|
| 5,575,719 | A * | 11/1996 | Gobush et al. | 473/223 |
| 6,041,651 | A * | 3/2000 | Naruo et al. | 73/491 |
| 6,565,448 | B2 * | 5/2003 | Cameron et al. | 473/131 |
| 7,041,014 | B2 * | 5/2006 | Wright et al. | 473/409 |
| 7,291,072 | B2 * | 11/2007 | Bissonnette et al. | 473/198 |
| 7,542,130 | B2 * | 6/2009 | Saegusa | 356/28 |
| 7,621,828 | B2 * | 11/2009 | Voges et al. | 473/409 |
| 2003/0008731 | A1 * | 1/2003 | Anderson et al. | 473/407 |
| 2005/0213076 | A1 * | 9/2005 | Saegusa | 356/28 |

FOREIGN PATENT DOCUMENTS

| | | |
|---|---|---|
| JP | 3073828 | 9/1993 |
| JP | 09-215807 | 8/1997 |
| JP | 2001-314540 | 11/2001 |
| JP | 2005-74013 | 3/2005 |
| JP | 2007-244716 | 9/2007 |

OTHER PUBLICATIONS

Notification of Reasons for Refusal, dated Jun. 9, 2009.

* cited by examiner

*Primary Examiner*—Nini Legesse
(74) *Attorney, Agent, or Firm*—Knobbe Martens Olson & Bear, LLP

(57) ABSTRACT

A method for golf club selection uses a behavior of the golf swing when a golf club is gripped and swung. The method for golf club selection has a step of obtaining information of a vertical movement direction relative to a horizontal plane of a golf club head immediately before striking a golf ball, and information of the horizontal movement direction of the golf club head immediately before striking the golf ball on a plane parallel to the horizontal plane, a step of classifying the golf swing step as a predetermined type using the information of the vertical movement direction and information of the horizontal movement direction obtained, and a step of selecting a golf club suited for the classification according to the classification result.

7 Claims, 9 Drawing Sheets

| No. | FACE SPEED | APPROACH ANGLE (VERTICAL) | APPROACH ANGLE (HORIZONTAL) | DYNAMIC LOFT | FACE ANGLE | LIE ANGLE | STRIKE POINT (VERTICAL) | STRIKE POINT (HORIZONTAL) |
|---|---|---|---|---|---|---|---|---|
| 1 ○ | 40.64 | 3.7 | 1.5 | 11.5 | 2.2 | −13.1 | 6.0 | 10.6 |
| 2 □ | 40.92 | 4.5 | 1.6 | 13.0 | 4.0 | −13.7 | 7.7 | 8.8 |
| 3 △ | 41.48 | 4.5 | 2.6 | 11.4 | 3.6 | −13.8 | 14.1 | −2.2 |
| 4 × | 41.21 | 3.9 | 2.0 | 14.2 | 4.0 | −14.4 | 2.0 | −8.5 |

METHOD FOR GOLF CLUB SELECTION, AND GOLF CLUB

The entire contents of literatures cited in this specification are incorporated herein by reference.

BACKGROUND OF THE INVENTION

The present invention relates to a method for selecting a golf club, and a golf club, and specifically relates to a method for golf club selection using the behavior of the golf swing of a golf club when the golf club has been gripped and swung.

Conventional methods for measuring and analyzing golf swings include methods which photograph a golf swing with a camera, analyze the behavior of the golf club head from the photographic image, and extract the characteristics of the golf swing; methods which directly measure the behavior of the golf club head with a magnetic sensor; and methods which measure the behavior of the golf club head using an interrupter type optical sensor that senses the passage of the golf club head as it intersects a plurality of light beams disposed at predetermined positions.

Although all of these methods can measure the approximate track of the golf club head, they cannot accurately measure the behavior of the golf club head immediately before impact with the golf ball which determines the track and height of the golf ball trajectory.

JP 2001-314540 A and JP 3073828 B disclose apparatuses capable of measuring the behavior of a golf club when striking a golf ball.

As disclosed in paragraph [0023] of JP 2001-314540 A, the incidence angle of the golf club head relative to the golf ball can be approximately known by arranging four sensors. JP 3073828 B similarly discloses that the incidence angle of a golf club head relative to a golf ball can be approximately known by arranging four sensors.

SUMMARY OF THE INVENTION

In the measurements of the behavior of the golf club according to JP 2001-314540 A and JP 3073828 B, however, information cannot be obtained for selecting a golf club which matches the track, such as a hook, slice and the like, of the golf ball, even though the incidence angle of the golf club head relative to the golf ball can be approximately known.

Today, golfers want to select golf clubs suited to their personal golf swing, as well as improve their golf swing in order to make golf more enjoyable. Given this situation, the devices disclosed in JP 2001-314540 A and JP 3073828 B cannot obtain information for selecting a golf club which is suited to the golfer's own swing that influences the track of the golf ball, such as hooking and slicing as well as a higher or lower golf ball trajectory.

To solve the problems of the conventional art, an object of the present invention is to provide a method for selecting a golf club capable of selecting a golf club optimally suited to the golf swing according to the results of a golf swing analysis. Another object to the invention is to provide a golf club for use in this selection method.

A first aspect of the present invention provides a method for golf club selection using a behavior of a golf swing when a golf club is gripped and swung, comprising the steps of: obtaining, during a golf swing, information of a vertical movement direction relative to a horizontal plane of a golf club head immediately before striking a golf ball, and information of a horizontal movement direction of the golf club head immediately before striking the golf ball on a plane parallel to the horizontal plane, classifying the golf swing as one of predetermined types using the information of the vertical movement direction and the information of the horizontal movement direction obtained, and selecting a golf club suited for the one of the predetermined types according to a classification result.

Preferably, the step of classifying the golf swing as the one of the predetermined types is performed by plotting a state of the golf swing for which the information of the vertical movement direction and the information of the horizontal direction were obtained, in a two-dimensional chart in which values of the horizontal movement direction and values of the vertical movement direction are plotted on coordinate axes using the information of the horizontal movement direction and the information of the vertical movement direction obtained.

Further, preferably, the step of obtaining the information of the vertical movement direction and the information of the horizontal movement direction uses measuring means to obtain three-dimensional position information of the golf club head by photographing a golf club from at least two directions, and obtaining the information of the vertical movement direction and the information of the horizontal movement direction from the three-dimensional position information.

Preferably, the step of obtaining the information of the vertical movement direction and the information of the horizontal movement direction obtains the information of the vertical movement direction and the information of the horizontal movement direction using separate measurement sensors.

Preferably, the suited golf club is selecting from among at least two types of golf clubs, which differ in one or both of a centroid distance which is a distance of a shortest line connecting a center of gravity point of a golf club and a center axis or an extended line of the center axis of a golf club shaft, and an angle of centroid representing a direction of the shortest line.

A second aspect of the present invention provides a golf club selected by the method for golf club selection according to the first aspect of the present invention, comprising a display medium for displaying information of a classified swing type.

The present invention can select a golf club according to a classified golf swing because information of the movement in the vertical direction and in the horizontal direction of the golf club head is obtained and the golf club swing can be readily classified using this information.

Particularly, a golfer can easily be made visually aware of his own golf swing because the measurement results can be presented on a two-dimensional chart plotting the information of the movement in the vertical direction and information of the movement in the horizontal direction. Furthermore, golf club selection to which the golfer assents can be executed because golf club selection is performed according to each type.

DETAILED DESCRIPTION OF THE INVENTION

The method for selecting a golf club and the golf club of the present invention are described in detail hereinafter based on the preferred embodiments shown in the appended drawings.

The method for selecting a golf club of the present invention is a method which involves obtaining information pertaining to the movement direction, separated into a vertical movement direction and a horizontal movement direction, of a golf club head immediately before striking a golf ball when a golfer has gripped the golf club and performed a golf swing, classifying the golf swing by type based on the obtained information, and selecting a golf club suited to the type of golf swing.

Described first is the measuring means for obtaining information of the movement direction, separated into a vertical movement direction and a horizontal movement direction, immediately before striking a golf ball.

Figure 1:
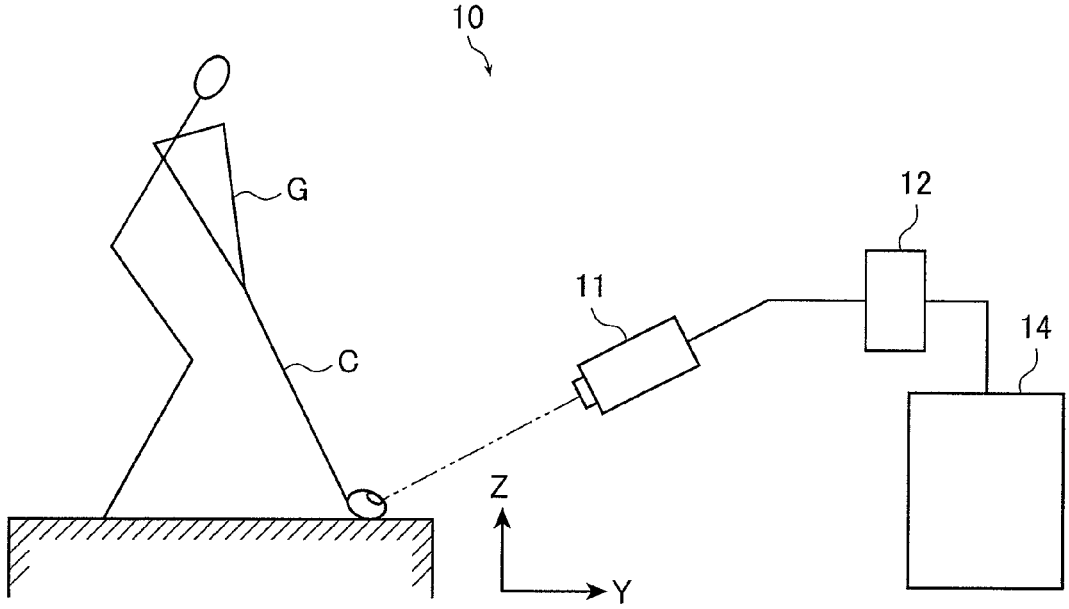
FIG. 1 is a schematic view showing an example of a head measuring apparatus which uses the golf club selection method of the present invention.

FIG. 1 is a schematic view showing a head measuring apparatus 10 for obtaining information of the movement direction, separated into a vertical movement direction and a horizontal movement direction, of a golf club head immediately before striking a golf ball. The head measuring apparatus 10 shown in FIG. 1 includes an illumination and photography section 11 for photographing a golf club head via stereo photography using light from two different directions, a control device 12 for controlling the illumination and photography section 11, and a computer system 14 for performing signal processing, image processing, and operation analysis of the obtained data of the images photographed by the illumination and photography section 11, as well as classifying the golf swings into types and selecting an optimum golf club.

Figure 2A:
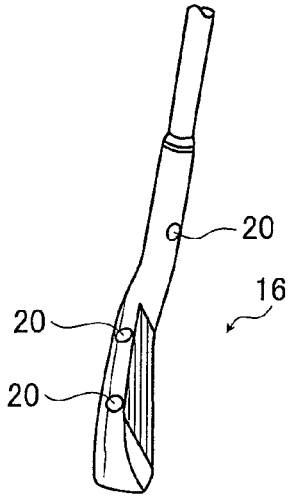
FIGS. 2A and 2B are a schematic perspective views showing a golf club head, which is the measurement object of the head measuring apparatus show in FIG. 1.
Figure 2B:
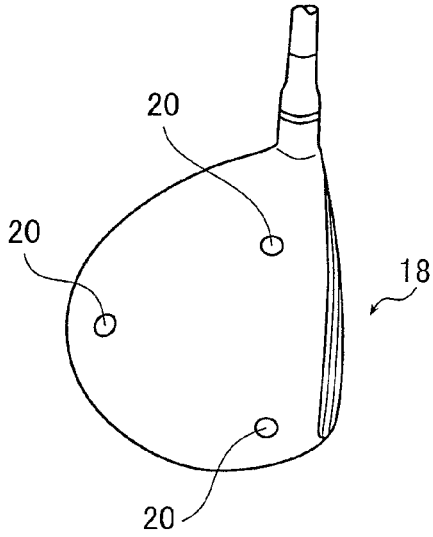

FIGS. 2A and 2B show golf club heads 16 and 18, which are the measurement objects of the head measuring apparatus 10. The iron type golf club head 16 is provided with retroreflection marks 20 on the hosel and the top edge surface of the golf club head 16 which connects to the striking surface. As shown in FIG. 2B, the wood type golf club head 18 is provided with retroreflection marks 20 at three locations on the top surface which forms a crown portion that connects to the striking surface.

The retroreflection marks 20 are provided at least three locations on the golf club head and these retroreflection marks 20 are positioned so as to form the vertices of a triangle and are not in a single straight line. In the example of FIG. 2A, a single retroreflection mark 20 is provided on the hosel so that the three retroreflection marks are not positioned in a single straight line.

Figure 3A:
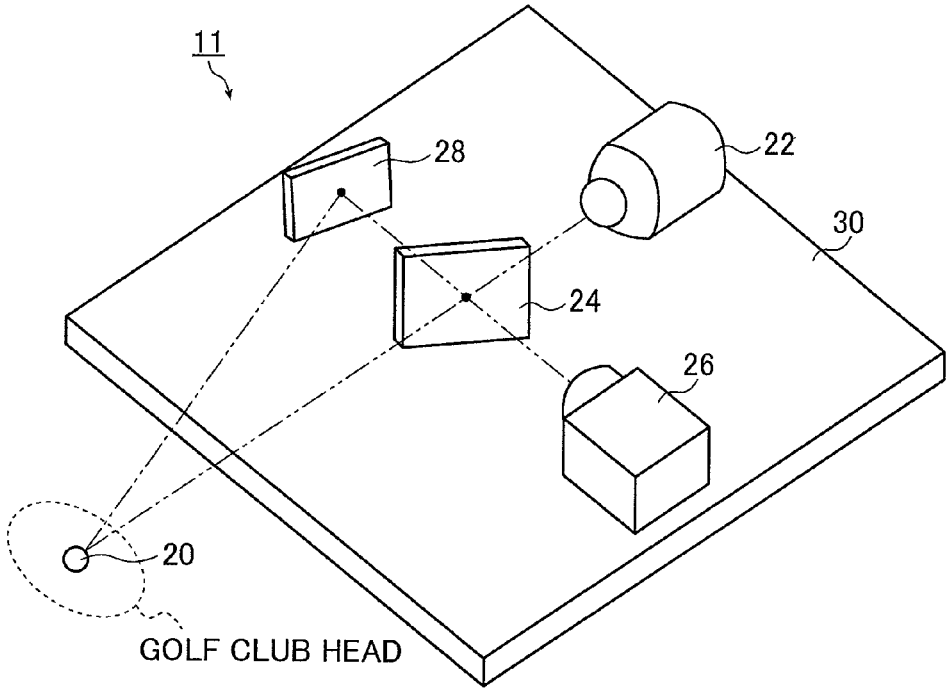
FIG. 3A is a perspective view showing the structure of the illumination and photography section of the head measuring apparatus shown in FIG. 1.
Figure 3B:
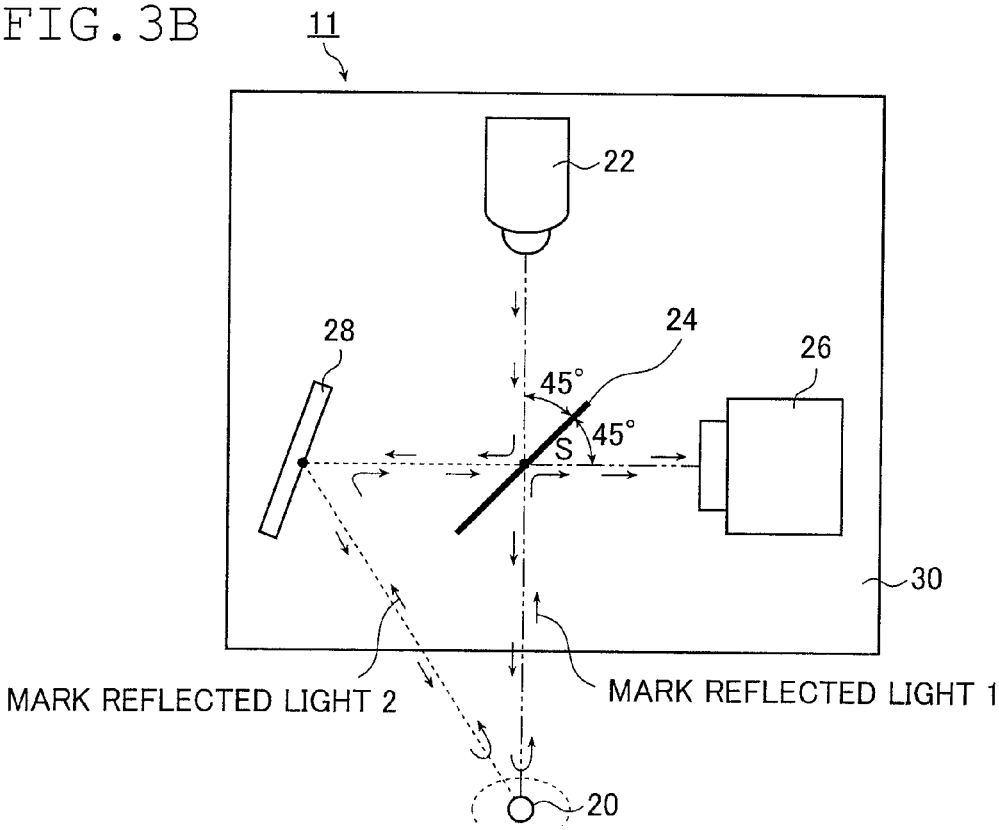
FIG. 3B is a top plan view of the illumination and photography section.

FIG. 3A is a perspective view showing a part of the head measuring apparatus 10 which configures the illumination and photography section 11 for performing stereo photography. FIG. 3B is a top plan view of the illumination and photography section 11.

As shown in FIGS. 3A and 3B, the illumination and photography section 11 includes an illumination light source 22 for illuminating a measurement object, a half mirror 24 which possesses properties for transmitting and reflecting light which impinges on an interface, a camera 26, a reflective mirror 28 which has a totally reflective surface for performing total reflection and possesses functions for adjusting the reflection direction (angle) on the totally reflective surface, its position and the like, and a plane surface 30 for mounting these members.

The illumination light source 22 is a halogen light source which emits continuous light. The illumination light source 22 is provided on the plane surface 30, and is arranged to illuminate the retroreflection marks 20 on the golf club head through the half mirror 24.

The half mirror 24 is planar in shape, and has an interface for emitting (reflection and transmission) the light which has entered from one side. The half mirror 24 rises vertically relative to the planar surface 30, and the direction of the interface is adjusted so that the optical path of the light emitted from the illumination light source 22 forms an incidence angle of approximately 45° when impinging on the interface of the half mirror 24.

The camera 26 has a light receiving portion such as a lens, and photographs the image which impinges on the light receiving portion. The camera 26 is provided on the planar surface 30 so that a line of sight axis of the camera 26 is directed toward a position at which the light from the illumination light source 22 passes through the half mirror 24, forming an angle of approximate 90° with the optical path of the illumination light passing through the half mirror 24 to illuminate the golf club head.

The reflective mirror 28 is provided and the direction of the totally reflective surface is adjusted so that the light emitted from the illumination light source 22 and reflected by the half mirror 24 is reflected by the reflective mirror 28 and illuminates the retroreflective marks 20 of the golf club head, and the light reflected from the retroreflective marks 20 enters the camera 26 via the reflective mirror 28 and the half mirror 24.

As shown in FIG. 3B, the illumination and photography section 11 has the illumination light source 22 facing the interface of the half mirror 24 and emitting continuous light. The emitted light is transmitted through the half mirror 24, and is emitted from the half mirror 24 as transmission light which passes through position S on the interface of the half mirror 24. The emitted transmission light illuminates the retroreflection marks 20 provided on the golf club head which is the measurement object. The light reflected from the retroreflection marks 20 (hereinafter referred to as "mark reflected light 1") proceeds to the interface of the half mirror 24. The incidence angle at which the mark reflected light 1 impinges on the interface of the half mirror 24 approximately, matches the output angle formed by the interface of the half mirror 24 and the light from the interface of the half mirror 24 that illuminates the retroreflection mark 20 since the mark reflected light 1 proceeds in the opposite direction to the illumination light and this reflected light has the same optical path as the illumination light. Thus, the reflected light which impinges on the half mirror 24 is reflected to the camera 26 and enters the lens and the like of the light receiving portion of the camera 26.

On the other hand, among the light emitted from the illumination and photography section 11, the light reflected by the half mirror 24 impinges on the totally reflective surface of the reflective mirror 28, as shown in FIG. 3B. The totally reflected light becomes illumination light which illuminates the retroreflection mark 20 provided on the golf club head that is the measurement object. The illumination light reflected from the retroreflection mark 20 (hereinafter referred to as "mark reflected light 2") travels on the same optical path as the illumination light totally reflected from the reflective mirror 28 for illuminating the retroreflection mark 20, and proceeds toward the totally reflective surface of the reflective mirror 28. Then, at the totally reflective surface of the reflective mirror 28, the mark reflected light 2 is reflected toward the half mirror 24. At the half mirror 24, the reflection angle (exit angle) of the light emitted from the half mirror 24 toward the reflective mirror 28 is approximately the same as the incidence angle at which the mark reflected light 2 impinges on the half mirror 24.

The mark reflected light 2 which passed through the half mirror 24 enters the lens and the like of the light receiving portion of the camera 26 together with the mark reflected light 1 which was reflected by the half mirror 24.

Therefore, the camera 26 photographs the image of the reflection mark formed by two reflected light reflected from the retroreflection mark 20 in two directions and traveling on approximately the same optical paths as the illumination light emitted from the half mirror 24 in two different directions.

Note that in the present embodiment, the golf club head is illuminated with light from two different directions and an image of the golf club head is photographed using light from two different directions. The present invention is satisfied insofar as the golf club head is photographed using light from at least two directions; for example, images of the golf club head may be photographed from different directions by three or more cameras using well known motion capture systems.

In this case, the position and direction of the reflective mirror 28 shall be micro-adjustable so that the mark reflected light 1 and the mark reflected light 2 may form images at different positions.

The images of the retroreflection mark of the golf club head can therefore be photographed as a stereo image by a single camera 26. The two images may be captured, for example, as two vertical image segments. In photography, the image of the retroreflection mark images can be captured at 1/2000 second intervals within a single image by multiple exposures.

Insofar as the optical member used can reflect or transmit the light entering from two directions from or through the interface, the half mirror 24 may be replaced by a half prism or any of various beam splitters. Although the ratio of reflectivity at the interface is not specifically limited, an approximate 1:1 ratio is desirable.

The reflective mirror used may have the following configuration.

Figure 4:
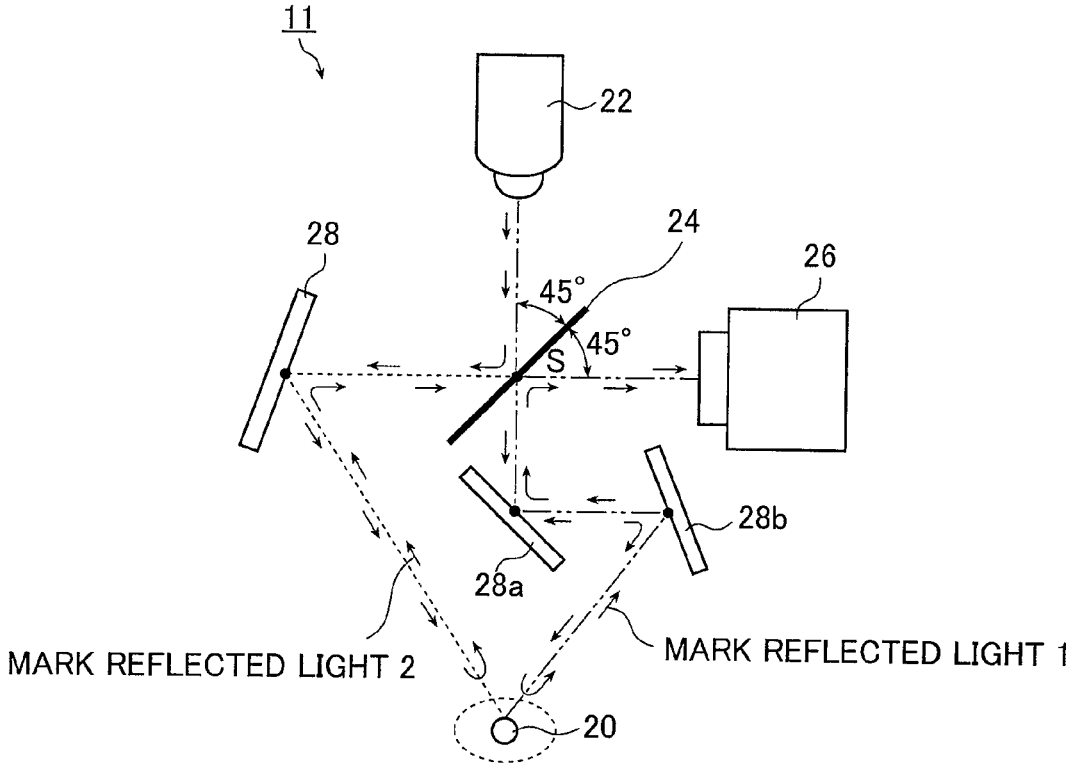
FIG. 4 is a top plan view showing the structure of an illumination and photography section which differs from the structure of the illumination and photography section shown in FIG. 3A.

FIG. 4 shows another example of the illumination and photography section in which in addition to the reflective mirror 28, reflective mirrors 28*a* and 28*b* are disposed in the optical path of the illumination and photography section 11 so that the mark reflected light 1 and the mark reflected light 2 have approximately the same optical path length.

By providing the reflective mirrors 28*a* and 28*b* in the optical path of the mark reflected light 1, the optical path of the mark reflected light 1 from the retroreflection mark 20 to the half mirror 24 can be lengthened and set to the length of the optical path of the mark reflected light 2. That is, in a device provided with the configuration shown in FIG. 4, the optical path of the mark reflected light 1 is longer than that shown in FIG. 3B, and the optical paths from the mark reflected light 1 and the mark reflected light 2 to the camera 26 can have approximately the same length.

The camera 26 can focus and photograph the two retroreflection mark images by having the lengths of the optical paths closer in this manner.

In this case, the respective output angles at which the illumination light for illuminating the mark from two different directions exit from the interface of the half mirror 24 approximately match the incidence angles at which light reflected from the retroflection mark in two directions (mark reflected light 1 and mark reflected light 2) impinge on the interface of the half mirror 24. Thus, the image can be photographed at high contrast from the two light reflected in two directions from the retroreflection mark 20 provided on the golf club head.

The image obtained by the illumination and photography section 11 is transmitted through the control device 12 to the computer system 14 which is the movement calculator. The computer system 14 performs predetermined processing and analysis, and calculates the movement direction of the golf club head which is the measurement object. Moreover, the golf swing is classified based on the information of the movement direction, and an optimal golf club is selected according to the classification result.

The computer system 14 first obtains the images of the retroreflection marks 20 of the golf club head as a stereo image, and hence plots, in a time series, the two-dimensional position coordinates (center position coordinates) of the images of the retroreflection marks 20 from the obtained stereo image. Then, the three-dimensional position coordinates of the images of the retroreflection marks 20 are calculated using the two-dimensional position coordinates of the images of the retroreflection marks 20 obtained from the stereo image. The three-dimensional position coordinates of the images of the retroreflection marks 20 can be calculated by pre-preparing a reference table representing the associative relationship between the three-dimensional position coordinates and the two-dimensional position coordinates obtained from the stereo images using an object having already known three-dimensional position coordinates, and establishing a calibration method, for example, an interpolation method which uses this reference table.

Figure 5:
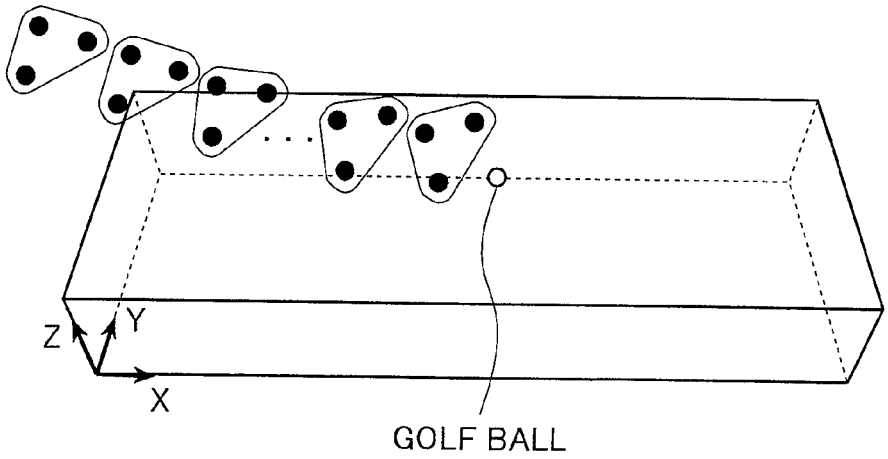
FIG. 5 is a schematic view showing the movement trajectory of a golf club head obtained by the head measuring apparatus shown in FIG. 1.

The three-dimensional position coordinate data obtained in this way can be represented in a three-dimensional mode such as that shown in FIG. 5. The example shown in FIG. 5 shows a result of the behavior of the retroreflection marks 20 obtained relative to the arrangement of the retroreflection marks 20 shown in FIG. 2B.

The position and direction of the golf club head are determined from the three-dimensional position coordinate data of the retroreflection marks 20 represented in the time series. Specifically, the position and direction of a virtual golf club head is adjusted so that the position coordinates of the three retroreflection marks 20 arranged on the virtual golf club head in the computer system 14 match the three-dimensional position coordinates calculated from the image. In this way the position and direction of the golf club head during the golf swing can be known. The position of the golf club head is expressed by using the position coordinates at the center position of the club face plane as the representative position of the golf club head.

The computer system 14 determines the information of the horizontal movement direction (Y direction in FIG. 1) and the information of the vertical movement direction (Z direction in FIG. 1) relative to the horizontal plane of the golf club head immediately before striking the golf ball from the time series data of the position coordinates of the center position of the club face plane which is the determined representative position of the golf club head. The vertical direction refers to a direction perpendicular to the horizontal plane on which the golfer grips the golf club and addresses. The horizontal direction refers to a direction orthogonally intersecting the direction (a direction perpendicular to the paper surface in FIG. 1; the X direction in FIG. 5) in which the golfer intends to strike the golf ball on a plane parallel to the horizontal plane.

Specifically, with regard to the calculation of the vertical movement direction and the horizontal movement direction the movement distance of the position coordinates rapidly reduces immediately before striking and immediately after striking compared to the movement distances at precedent time points in the time series data of the position coordinates which represent the movement of the center position of the club face plane at fixed time intervals because the movement speed of the golf club head reduces immediately after striking the golf ball. Utilizing this information, the position coordinate data immediately before the golf club strikes the golf ball can be known. The vertical movement direction and horizontal movement direction can be determined by calculating the difference between this position coordinate value and the value of the position coordinate data one interval prior in the time series data.

The computer system 14 obtains the approach angle (vertical) as information of the vertical movement direction and the approach angle (horizontal) as information of the horizontal movement direction from the movement trajectory of the center position of the golf club face plane immediately before striking the golf ball as will be mentioned later.

The approach angle (vertical) of the golf club head 18 in the present embodiment is described below.

Figure 6A:
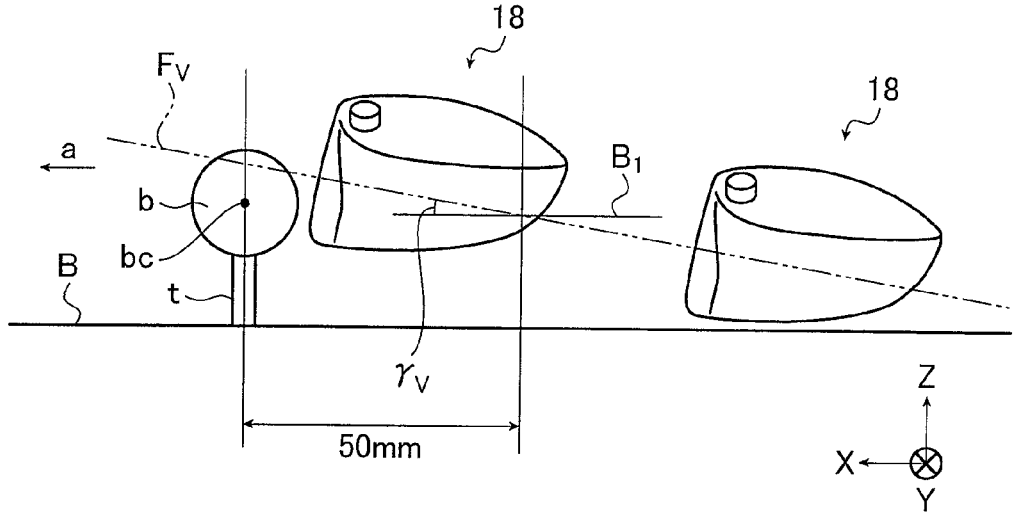
FIG. 6A is a schematic view illustrating the approach angle (vertical) of the golf club head.

FIG. 6A shows a golf ball b disposed on a tee t on a horizontal plane B as viewed from the Y direction (side); when the golf ball b is viewed from the side as shown in FIG. 6A, the movement trajectory when the golf club head 18 is facing the golf ball b at the time the ball is struck is designated movement trajectory $F_v$ of the golf club head 18. The movement trajectory $F_v$ represents the movement trajectory of the center position of the club face plane of the golf club head 18 using the time series data of the position coordinates that represent the calculated movement of the center position of the club face plane of the golf club 18.

The approach angle (vertical) of the present embodiment refers to the angle $\gamma_v$ formed by the movement trajectory $F_v$ and the plane $B_1$ which is parallel to the horizontal plane B within a position 50 mm distant, in the opposite direction to the X direction, from the center bc of the disposed golf ball b (referred to as a position within 50 mm from the golf ball b).

In FIG. 6A, the angle $\gamma_v$ is shown at a position exactly 50 mm distant from the golf ball b.

In the approach angle (vertical) in the present embodiment, the top side of the plane $B_1$ which is parallel to the horizontal plane B is designated a positive (+) angle, and the bottom side of the plane $B_1$ which is parallel to the horizontal plane B is designated a negative (−) angle.

The approach angle (horizontal) of the golf club head 18 in the present embodiment is described below.

Figure 6B:
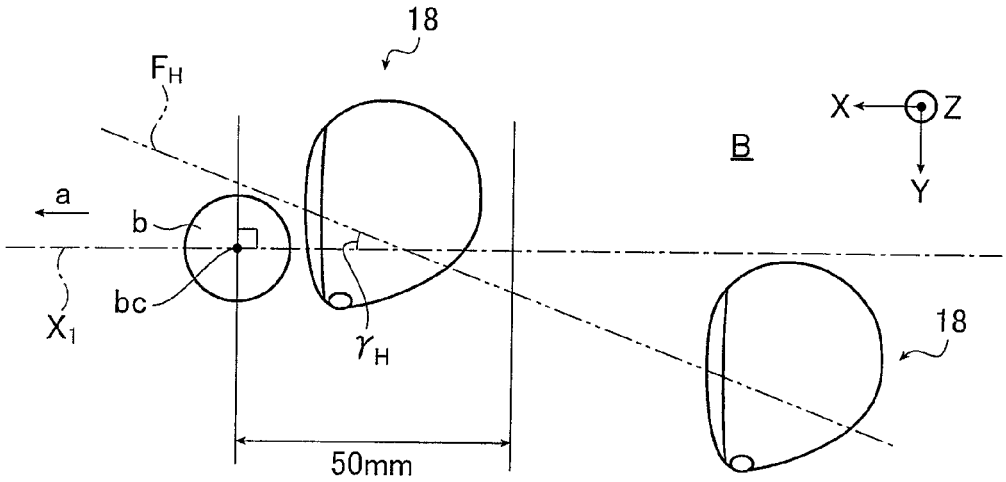
FIG. 6B is a schematic view illustrating the approach angle (horizontal) of the golf club head.

FIG. 6A shows a golf ball b disposed on a tee t on a horizontal plane B as viewed from the opposite direction (top) to the Z direction; in FIG. 6B, the golfer (not shown) stands-on the bottom side of the drawing.

When the golf ball b is viewed from above as shown in FIG. 6B, the movement trajectory when the golf club head 18 faces the golf ball b and strikes the ball is designated the movement trajectory $F_H$ of the golf club head 18. The movement trajectory $F_H$ represents the movement trajectory of the center position of the club face plane of the golf club head 18 using the time series data of the position coordinates that represent the calculated movement of the center position of the club face plane of the golf club 18.

The plane which passes through the center bc of the disposed golf ball b, and is parallel to the X direction and perpendicular to the horizontal plane B is designated plane $X_1$.

The approach angle (horizontal) of the present embodiment refers to the angle $\gamma_H$ formed by the plane $X_1$ and the movement trajectory $F_H$ at a position within 50 mm from the golf ball b.

In the approach angle (horizontal) in the present embodiment, the opposite side of the golfer from plane $X_1$ is designated a positive (+) angle, and the golfer side of the Plane $X_1$ is designated a negative (−) angle.

Figure 7:
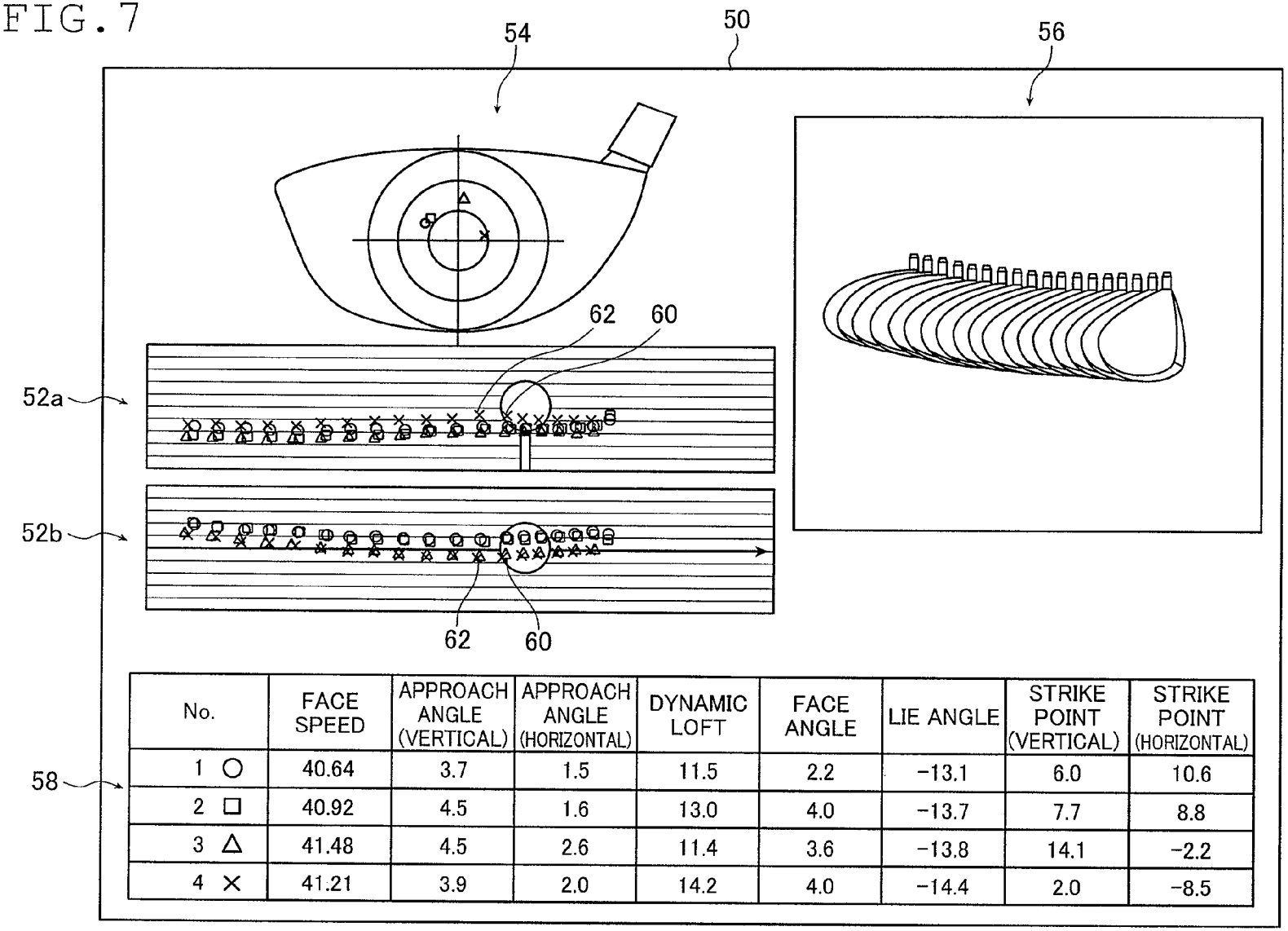
FIG. 7 is a schematic view showing an example of the measurement results obtained by the head measuring apparatus shown in FIG. 1.

FIG. 7 shows an example of the data obtained in this manner. The data is displayed on the screen of a display (not shown) which is connected to the computer system 14.

The trajectory of the center position of the club face plane of the golf club head is displayed on a display screen 50 shown in FIG. 7, which shows a graph 52*a* of the vertical movement trajectory, and a graph 52*b* of the horizontal movement trajectory. Information of the position of the club face plane which has struck the golf ball as determined by this trajectory is also shown in a region 54. The movement trajectory of the golf club head is also displayed in a region 56 by overwriting. A table containing the obtained data in the form of numeric values is displayed in a region 58.

Note that in FIG. 7 the approach angle (vertical) is obtained from the movement trajectory of the graph 52*a* as information of the vertical movement direction, and the approach angle (horizontal) is obtained from the movement trajectory of the graph 52*b* as information of the horizontal movement direction by determining the movement direction between position 60 and position 62 immediately before the golf ball is struck.

As shown on the display screen 50 shown in FIG. 7, the approach angle (vertical) is 3.7 degrees, 4.5 degrees, 4.5 degrees, and 3.9 degrees, and the approach angle (horizontal) is 1.5 degrees, 1.6 degrees, 2.8 degrees, and 2.0 degrees as determined by four golf swings.

Figure 8A:
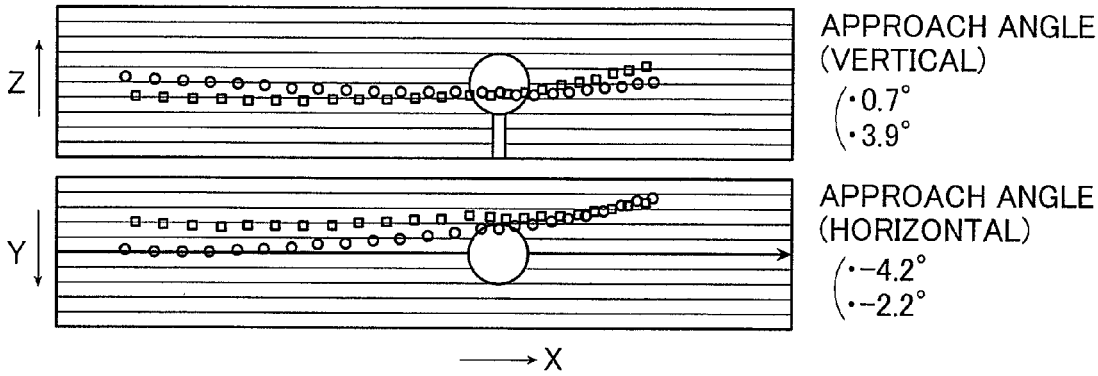
FIGS. 8A through 8C are graphs showing other examples of the measurement results obtained by the head measuring apparatus shown in FIG. 1.
Figure 8B:
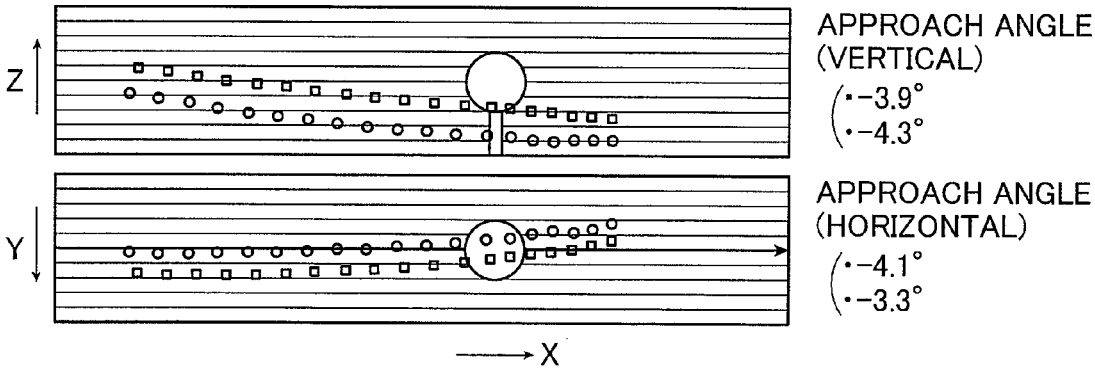
Figure 8C:
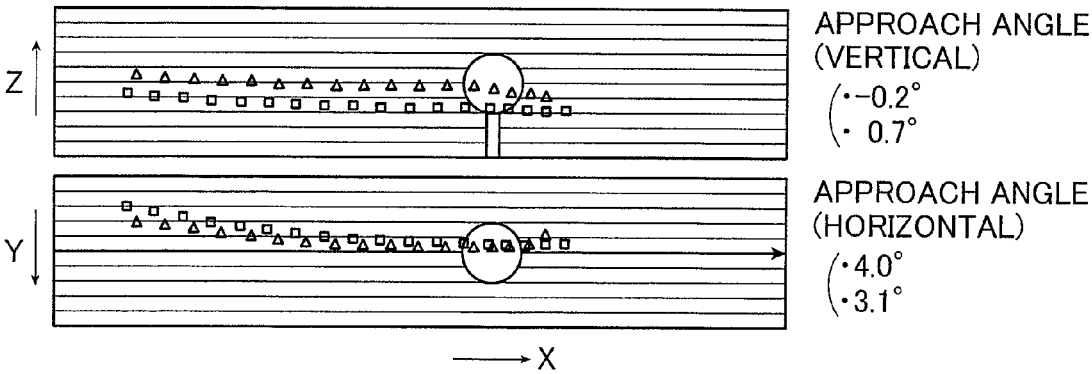

FIGS. 8A through 8C show the approach angle (horizontal), approach angle (vertical), and trajectory of the center position of the club face plane of a golf club head by other golfers. The results portray two golf swings by the respective individual golfers.

In FIG. 8A, the approach angle (vertical) is positive, and the club face plane is moving in a direction to hit the golf ball upward immediately before striking the ball. Therefore, the ball will fly in a high trajectory. On the other hand, the approach angle (horizontal) is negative, and the trajectory of the club face plane immediately before striking the golf ball shows an outside-in inclination. Therefore, the struck golf ball will have a trajectory with a slicing inclination.

In FIG. 8B, the approach angle (vertical) is negative, and the club face plane is moving downward immediately before striking the golf ball. Therefore, the ball will fly in a low trajectory. On the other hand, the approach angle (horizontal) is negative, and the trajectory of the club face plane immediately before striking the golf ball shows an outside-in inclination. Therefore, the struck golf ball will have a trajectory with a slicing inclination.

In FIG. 8C, the approach angle (vertical) is approximately 0, and the club face plane is moving in a horizontal direction immediately before striking the golf ball. Therefore, the ball will fly in a suitably high trajectory. On the other hand, the approach angle (horizontal) is positive, and the trajectory of the club face plane immediately before striking the golf ball shows an inside-out inclination. Therefore, the struck golf ball will have a trajectory with a draw-to-hook inclination.

Thus, the trajectories of the golf club head variously differ immediately before the golfer hits the golf ball.

The computer system 14 plots the thus obtained information of the vertical movement direction and information of the horizontal movement direction in a previously prepared chart, and classifies the swings of the golfers.

Figure 9:
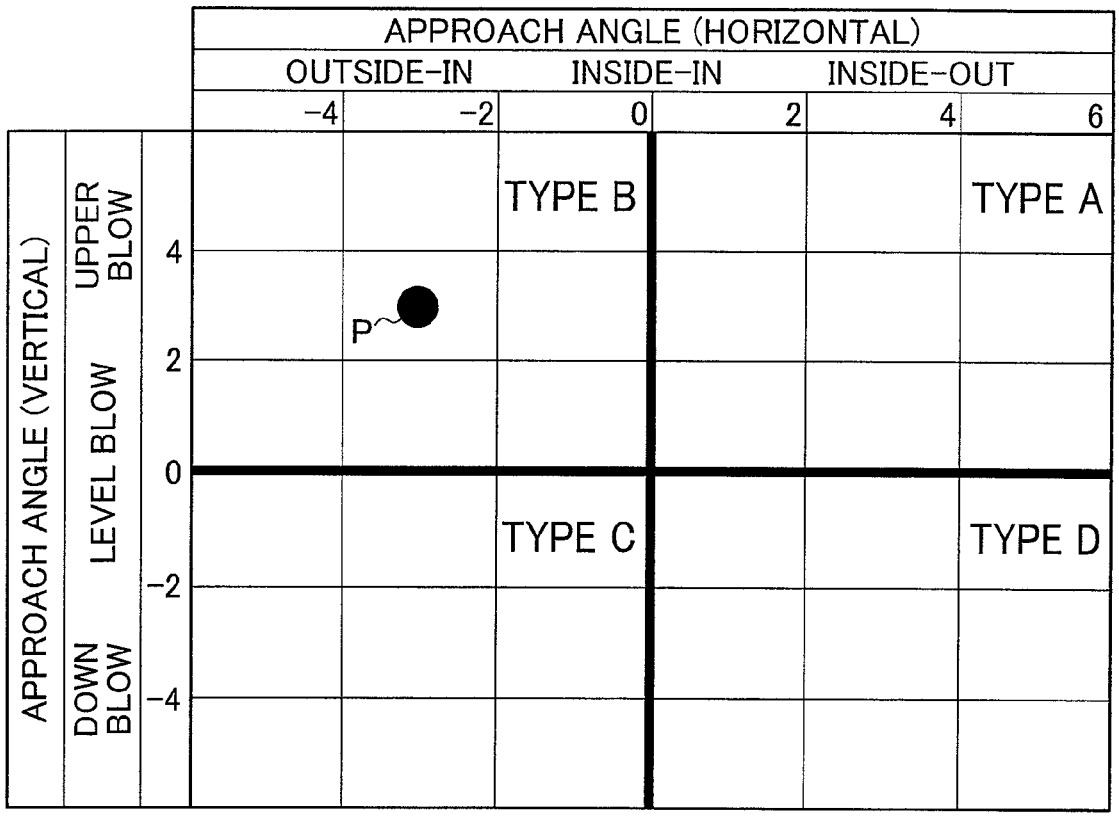
FIG. 9 is a schematic view showing an example of a chart used in the golf club selection method of the present invention.

The chart classifies four types of golf swing using the approach angle (vertical) (information of the vertical movement direction) on the vertical axis, and using the approach angle (horizontal) (information of the horizontal movement direction) on the horizontal axis. In FIG. 9, the plotted point P is classified as type B. In the chart shown in FIG. 9, each of the four type regions into which the chart is classified can be subdivided by dividing the information of the vertical movement direction and the information of the horizontal movement direction into three levels.

Note that in the present invention, the chart is not limited to one having four types of classification but the chart may have five or six types of classification, and the number of classifications and classification methods are not specifically limited in the present invention. For example, in a method of classification the values of the approach angle (vertical) on the vertical axis and the approach angle (horizontal) on the horizontal axis need not necessarily be standardized on the 0° position for classification. For example, the approach angle (vertical) on the vertical axis may be divided with reference to +3° position.

When the golf club head strikes the golf ball, a golf swing which moves from a downward direction to an upward direction (Z direction in FIG. 1) relative to the horizontal plane is called an upper blow, whereas a golf swing moving in the opposite direction is called a down blow. And a golf swing in which the golf club head moves from the inner side to the outer side as viewed from the golfer relative to a target direction in which the golf ball is intended to fly is called inside-out, whereas a swing in which the club head moves from the outer side to the inner side is called outside-in. That is, the vertical direction is based on the horizontal direction, and the horizontal direction is based on the target direction in which the golf ball is intended to fly.

In FIG. 9, type A and type B therefore have positive approach angles (vertical), representing that the golf club head moves from the lower side to the upper side (upper blow) immediately before striking the golf ball. Type C and type D have negative approach angles (vertical), representing that the golf club head moves from the upper side to the lower side (down blow) immediately before striking the golf ball.

On the other hand, type A and type D have positive approach angles (horizontal), representing that the golf club head moves from the golfer side toward the outer side (inside-out) immediately before striking the golf ball. Type B and type C have negative approach angles (horizontal), representing that the golf club head moves from the outer side of the golfer toward the inner side (outside-in) immediately before striking the golf ball.

Although the values of the approach angle (vertical) and the approach angle (horizontal) are displayed as angles in FIG. 9, the present invention is not limited to display as angles. These values may also be displayed in radian units. At least the information of the vertical approach direction and information of the horizontal approach direction of the golf club head are preferably displayed.

In the case of a type A swing, therefore, the golf ball tends to be hit as a draw or hook shot in a higher trajectory. In a type B swing, the golf ball tends to be hit as a fade or slice shot in a higher trajectory. In a type C swing, the golf ball tends to be hit as a fade or slice shot in a lower trajectory. In a type D swing, the golf ball tends to be hit as a draw or hook shot in a lower trajectory.

Figure 10:
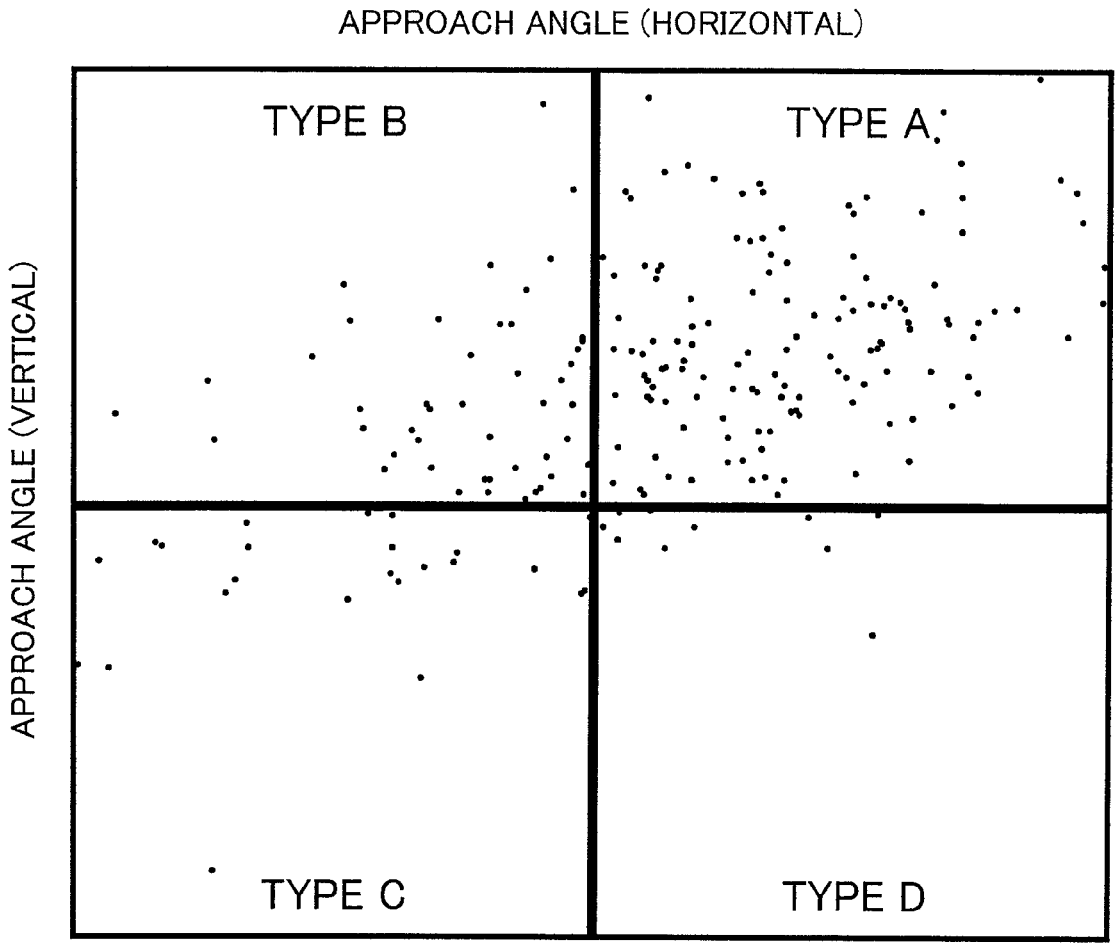
FIG. 10 shows classification results of a plurality of golfers plotted in the chart shown in FIG. 9.

FIG. 10 is a graph showing the results of a total of 250 people, including both professional golfers and amateur golfers, plotted in a chart. It can be understood that the number of plotted type D swings is relatively low, and there is divergence among the type A through type C swings.

Golf club data for the golf clubs suited to the swing types classified as type A through type D is prepared in the computer system 14. In the computer system 14, the golf club data of the optimum golf club for each of the swing types classified as type A through type D is selected from among the prepared golf club data of the various golf clubs. Then, a golf club is displayed on the display based on the selected golf club data. In this way a golf club can be selected by the computer system 14.

In the computer system 14, for example, a golf club is selected based on the golf club data of the golf clubs for each of the swing types classified as type A through type D as described below.

For example, a golf club which has been set so as not to increase the dynamic loft angle and not to close the club face plane as viewed from the golfer is selected for type A.

The golf club selected for type B is a golf club set so that the orientation of the club face immediately before striking the golf ball will not be facing upward due to the centrifugal force acting on the center of gravity of the golf club head, that is, set so as not to increase the dynamic loft angle and not to open the club face plane as viewed from the golfer.

The golf club selected for type C is a golf club set so that the orientation of the club face immediately before striking the golf ball will not be facing upward due to the centrifugal force acting on the center of gravity of the golf club head, that is, set so as to increase the dynamic loft angle and not to open the club face plane as viewed from the golfer.

The golf club selected for type D is a golf club which has been set so as to increase the dynamic loft angle and not to close the club face plane as viewed from the golfer.

It is preferable that golf clubs obtained by adjusting a centroid distance and a angle of centroid of the golf club head be used as these golf clubs. That is, the optimum golf club heads in type A through type D are configured so that at least one of the centroid distance and the angle of centroid is different. For example, the optimum golf club head for type A will have a different angle of centroid than the optimum golf club head for type B, and the angle of centroid of the optimum golf club head for type A will be smaller than the angle of centroid of the optimum golf club head for type B. The optimum golf club head for type A also has a different centroid distance than the optimum golf club head for type C, and the centroid distance of the optimum golf club head for type A is shorter than the centroid distance of the optimum golf club head for type C.

Figure 11:
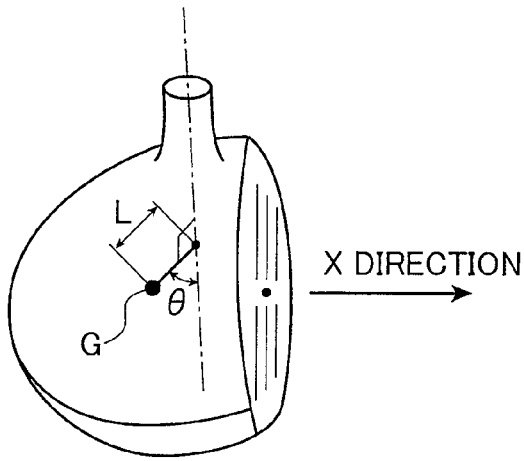
FIG. 11 is a schematic view illustrating the centroid distance and angle of centroid of the golf club head.

Note that the centroid distance of the golf club head is the distance L of the shortest straight line when the shortest straight line from a center of gravity point G of the golf club head to the center axis or the extended line of the center axis of the golf club shaft has been determined, as shown in FIG. 11. The angle of centroid is the angle formed between the shortest line and the center axis or the extended line of the center axis of the golf club shaft when the golf club head is disposed on the horizontal plane through a set lie angle, and the shortest line and the center axis or the extended line of the center axis of the golf club shaft are projected from a vertical direction toward the horizontal plane. That is, the angle of centroid is an angle representing the direction of the shortest line.

Note that although an optimum wood type golf club head is selected for each of type A through type D by adjusting the centroid distance and the angle of centroid in the present embodiment, the height of the center of gravity point from the horizontal plane may also be used in place of the centroid distance. Adjusting the height of the center of gravity point in an iron type golf club is particularly desirable. Note that the height of the center of gravity point is a dimension determined by $F_{GH}$ disclosed in JP 2005-211570 A.

When the grip angle θ on the golf club is set, the grip angle θ can be used in place of the angle of centroid as disclosed in JP 2006-247045 A. Clubs suited for swing type A through swing type D can be obtained by changing the grip angle θ to positive or negative according to the type A through type D.

Since the golfer grips the golf club with reference to a mark or an indication on the grip, the direction in which the face plane of the golf club head faces at address, that is, the direction of the movement of the face plane immediately before striking the golf ball is changed by changing the grip angle θ. The golf club best suited to each of type A through type D can therefore be provided. For example, In type B and type C, the grip angle θ is set positive, and in type A and type D the grip angle θ is set negative.

Note that the previously mentioned centroid distance can be determined, for example, as described below.

Figure 12A:
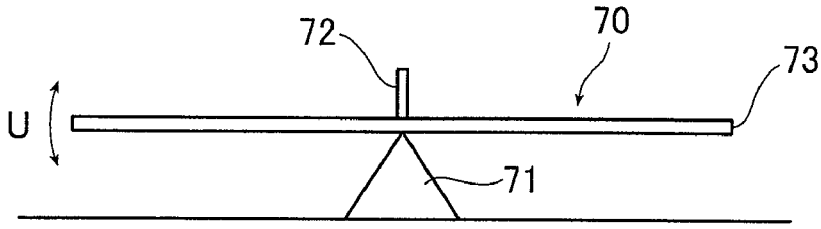
FIGS. 12A and 12B are schematic views illustrating the method for determining the centroid distance defined in the golf club of the present invention.
Figure 12B:
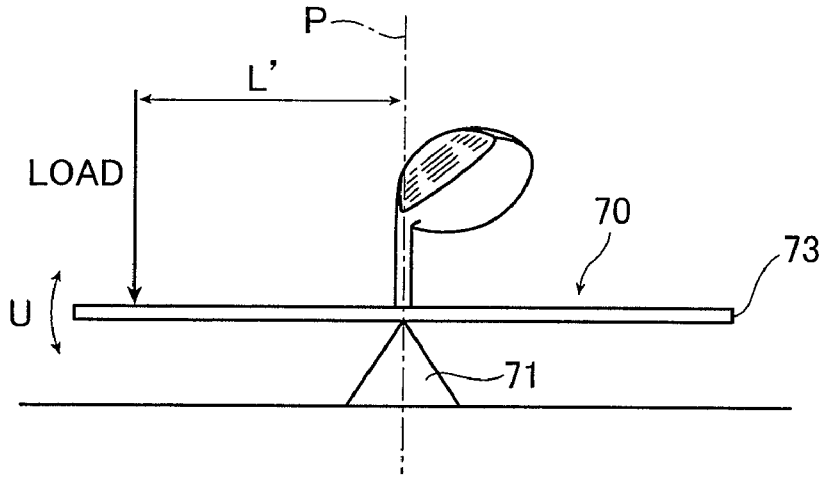

As shown in FIG. 12A, measurement is performed by a seesaw type scale 70 which is oscillatable in the arrow U direction pivoting on the fulcrum 71. The scale 70 has a shaft pin 72 for fitting into the hosel of the golf club head without a gap, so that when the golf club head is not installed, the arm 73 is balanced so as to be level. The measurement of the centroid distance L of the center of gravity point G of the golf club head from the golf club shaft axis is performed with the golf club head of weight W installed on the shaft pin 72 as shown in FIG. 12B. Then, the arm 73 is precision balanced at a predetermined position (L') as to be balanced at level, and the scale 70 measures the balanced load. The direction of the golf club head installed on the shaft pin 72 is then adjusted so as to increase the load, and the maximum load W' is determined; from the balance relation, the distance L is calculated by the formula $L=(W'\times L')/W$ based on the load W'. The calculated value is the centroid distance L.

It is desirable that information indicating the optimum for any of the type A through type D, that is, information of the classified type, is provided on a display medium such as a seal, tag or the like affixed to the golf club. The golfer can select a golf club suited for his own golf swing from among a large number of golf clubs based on the display medium.

Although four types of golf club corresponding to the type A through type D are prepared in the present embodiment, the present invention may prepare at least two types of golf club. For example, a single type of golf club can be used for types C and D so that two types or three types of golf club are prepared. However, it is preferable that the number of swing types be the same as the number of types of golf club, for example, four types of golf club are prepared when using type A through type D.

This head measuring apparatus 10 measures the information of the behavior of the golf club head when the golf club is gripped to strike the golf ball, and determines the information of the vertical movement direction and horizontal movement direction of the golf club head immediately before striking the golf ball. The golf swing is classified as one of four types using the information of the vertical movement direction and horizontal movement direction. The optimum golf club is selected from among golf clubs prepared according to such classification based on classification result.

Although a stereo image is photographed using the measuring apparatus shown in FIGS. 3A, 3B and 4 to obtain information of the vertical movement direction and horizontal movement direction in the present embodiment, the present invention does not limit the method of obtaining information of the vertical movement direction and horizontal movement direction with the measuring apparatus shown in FIGS. 3A, 3B and 4.

For example, a camera for obtaining information of the vertical movement direction of the golf club head and a camera for obtaining information of the horizontal movement direction of the golf club head may be disposed individually to separately obtain the information of the vertical movement direction and the horizontal movement direction.

Information of the vertical movement direction and horizontal movement direction may also be obtained by disposing well known coil sensors facing two different directions as disclosed in JP 2001-314540 A.

Moreover, a plurality of measurement sensors may be deployed on two parallel lines which intersect the movement path of the golf club head immediately before striking the golf ball to know which positions the golf club head passes through on the two parallel lines by knowing the measurement sensor which responds to the intersecting golf club head. Thus, the direction of behavior of the golf club head between two parallel lines can be determined. Information of the vertical movement direction and information of the horizontal movement direction can also be obtained separately by arranging two apparatus having this configuration.

As described above, information of the vertical movement direction and information of the horizontal movement direction of the golf club head can be obtained and the golf club swing can be readily classified using this information. Since the measurement results can be plotted on a two-dimensional chart, a golfer can easily visually recognize his own golf swing. Furthermore, golf club selection to which the golfer assents can be executed because golf club selection is performed according to each type.

Although the method for selecting a golf club and the golf club of the present invention have been described in detail, the present invention is not limited to theses embodiments and may be variously modified and improved insofar as such modification and variation does not depart from the scope of the present invention.

What is claimed is:

1. A method for golf club selection using a behavior of a golf swing when a golf club is gripped and swung, comprising the steps of:

obtaining, during a golf swing, a first value of an approach angle of a golf club head in a vertical direction relative to a horizontal plane immediately before striking a golf ball, and a second value of an approach angle of the golf club head in a horizontal direction on a plane parallel to the horizontal plane immediately before striking the golf ball;

classifying the golf swing as one of predetermined types using the obtained first value and the obtained second value; and selecting a golf club suited for the one of the predetermined types according to a classification result, wherein said classifying step is performed by plotting as a point showing a state of the golf swing the obtained first value and the obtained second value on a two-dimensional chart in which the approach angle in the horizontal direction and the approach angle in the vertical direction are two coordinate axes.

2. The method for golf club selection according to claim 1, wherein said obtaining step uses measuring means and comprises the steps of:

photographing the golf club from at least two directions, obtaining three-dimensional position information of the golf club head, and obtaining the first value and the second value from the three-dimensional position information.

3. The method for golf club selection according to claim 1, wherein said obtaining step obtains the first value and the second value using separate measurement sensors.

4. The method for golf club selection according to claim 1, wherein:

the suited golf club is selected from among at least two types of golf clubs, which differ in one or both of a centroid distance which is a distance of a shortest line connecting a center of gravity point of the golf club and a center axis or an extended line of the center axis of a golf club shaft, and an angle of centroid representing a direction of the shortest line.

5. A golf club selected by the method for golf club selection according to claim 1, comprising a display medium for displaying information of a classified swing type.

6. The method for golf club selection according to claim 1, wherein, in said selecting step, when the first value and the second value are positive, a golf club which has been set so as not to increase the dynamic loft angle and not to close the club face plane as viewed from a golfer is selected;

when the first value is positive and the second value is negative, a golf club which has been set so as not to increase the dynamic loft angle and not to open the club face plane as viewed from the golfer is selected;

when the first value and the second value are negative, a golf club which has been set so as to increase the dynamic loft angle and not to open the club face plane as viewed from the golfer is selected; and when the first value is negative and the second value is positive, a golf club which has been set so as to increase the dynamic loft angle and not to close the club face plane as viewed from the golfer is selected.

7. The method for golf club selection according to claim 1, wherein a standard point on said two-dimensional chart is a position in which the first value is 0° and the second value is 0°.

* * * * *